United States Patent [19]

Darner

[11] Patent Number: 4,733,435

[45] Date of Patent: Mar. 29, 1988

[54] ADJUSTABLE TRAVERSE ROD ASSEMBLY

[75] Inventor: Ronald G. Darner, Fort Atkinson, Wis.

[73] Assignee: Graber Industries, Inc., Middleton, Wis.

[21] Appl. No.: 943,387

[22] Filed: Dec. 16, 1986

[51] Int. Cl.[4] ..... A47H 15/00

[52] U.S. Cl. ..... 16/87.4 R; 16/94 D; 16/95 D; 160/345

[58] Field of Search ..... 16/87.4 R, 87.4 W, 87.6 R, 16/87.6 W, 93 R, 93 D, 94 R, 94 D, 95 R, 95 W, 95 D, 95 DW, 96 R, 96 D, 96 L; 160/345

[56] References Cited

U.S. PATENT DOCUMENTS 1,878,526 9/1932 Kenney et al. .
2,683,891 7/1954 Rosenbaum .
2,863,505 12/1958 Cameron .
3,314,100 4/1967 Znamirowski .
3,344,463 10/1967 Znamirowski .
3,470,578 10/1969 Graber et al. .
4,276,920 7/1981 Comeau .

*Primary Examiner*—Fred Silverberg
*Attorney, Agent, or Firm*—Vernon J. Pillote

[57] ABSTRACT

A traverse rod assembly comprising telescopically adjustable inner and outer rods of the type having a downwardly opening slot at the bottom of the rods. The inner and outer rods each have forward and rear guide rails along opposite sides of the slot and rolled or hemmed upper edges disposed at substantially the same level for supporting drapery carriers for movement along the slot in the inner and outer rods. The rails on the inner rod are provided with lower guide portions arranged to engage and laterally guide the carriers during movement along the inner rod. The inner and outer rods are formed with upper and lower reentrant angles in the top and bottom that define upwardly and downwardly opening channels adjacent the rear of the rod so that the rod can be supported by an intermediate support bracket that is concealed from view from the front of the rod.

19 Claims, 6 Drawing Figures

10
21
21a
21b
31a
31
11
31b
32
23
33
35c
25b
24b
34b
22
35b
25a
34a
35
35a
34
24a
25d
25c
25
35d
34c
24

21'
10'
31'
11'
32'
22'
33'
23'
35b'
25b'
24b'
34b'
35a'
35'
24a'
34a'
25a'
34'
35c'
34c'
25'
24'

ADJUSTABLE TRAVERSE ROD ASSEMBLY

BACKGROUND OF THE INVENTION

In adjustable traverse rods, the inner rod is smaller than the outer rod to be telescopically receivable therein and, during opening and closing of the drapery, at least some of the drapery carriers move across the transition between the inner and outer rods. It is known, for example as disclosed in U.S. Pat. Nos. 1,878,526, 2,863,505 and 4,276,920, to form the inner and outer rods such that, when the rods are telescoped, the edges of the metal strips from which the inner and outer rods are formed, are disposed alongside each other and at substantially the same level to guide the drapery carriers. While this construction provides a relatively smooth transition for the drapery carriers as they move between the inner and outer rods, the drapery carriers are supported on the slit edges of the strips and this produces wear and drag on the drapery carriers.

It is known, for example as disclosed in U.S. Pat. Nos. 2,683,891, 3,314,100 and 3,344,463, that the provision of hemmed edges on the inner and outer telescoping rods would reduce wear and drag on the drapery carriers. However, the provision of hemmed edges markedly complicates the problem of providing a smooth transition for the drapery carriers as they move between the inner and outer rod sections. In these patents, the rods have a rearwardly opening slot and the track and drapery carrier arrangements disclosed in these patents are unsuitable for use with rods having a downwardly opening slot. Further, the track and drapery carrier arrangements disclosed in these patents could not be used in one-way draw installations since the drapery carriers that move along the track of the outer rod section could not move along the track on the inner rod section, and vice versa.

It is frequently necessary to support the traverse rod at one or more locations intermediate its ends and various arrangements have heretofore been proposed for attaching the intermediate bracket to the rod in a manner to minimize visibility of the intermediate bracket from the front of the rod. For example, in the aforementioned U.S. Pat. No. 4,276,920, the intermediate bracket extends across the top of the rod and has portions engaging ribs on the front and rear sides of the rod. In U.S. Pat. No. 3,344,463, the intermediate bracket has a nose portion that engages in a dovetail groove at the top of the rod and a latch portion that engages a rearwardly projecting flange on the rod. In U.S. Pat. No. 3,470,578, the inner and outer rods are formed with a dovetail section at the rear of the rod and the mounting bracket has portions that grip the dovetail portion on the rod to support the rod from the rear side thereof. While this arrangement effectively concealed the intermediate bracket from view from the front side of the rod, the rod in this patent has a rearwardly opening slot or trackway disposed below the dovetail portion and the weight of the draperies suspended from the drapery carriers can pull the lower portion of the track downwardly away from the upper dovetail portion of the rod.

SUMMARY OF THE INVENTION

It is an object of the present invention to provide an adjustable traverse rod of the type having a downwardly opening slot and in which the rails on the inner and outer rods support the carriers on rounded edges that provide the same support height in both inside and outside rods and which assure that the slides do not have to move sideways more than a single metal thickness at the transition point between the inner and outer rods.

Another object of this invention is to provide an adjustable traverse rod in accordance with the foregoing object and which can be used in one-way draw installations.

A further object of this invention is to provide an adjustable traverse rod of the type having a downwardly opening slot in the bottom and in which the inner and outer rods have reentrant angles in the top and bottom rearwardly of the slot in the rod, and mounting brackets for engaging the reentrant angle to provide a concealed support for the rod at the rear of the rod.

In accordance with one aspect of the present invention, the traverse assembly comprises telescopically adjustable inner and outer rods formed of sheet metal and each including a top wall means, front wall means, rear wall means, and forward and rear bottom wall means spaced apart to define a downwardly opening slot therebetween. The forward and rear bottom wall means of the outer rod have respective forward and rear carrier guide rails extending upwardly along opposite sides of the slot in the outer rod and terminating in hemmed upper edges with the hems disposed at the side of the associated rail remote from the slot in the outer rod. The forward and rear bottom wall means of the inner rod have respective forward and rear guide rails along opposite sides of the slot in the inner rod and the forward and rear guide rails on the inner rod each have upper guide portions disposed alongside and at substantially the same level as the hemmed upper edges of the forward and rear guide rails on the outer rod, and the forward and rear guide rails on the inner rod each having a lower guide portion horizontally and vertically offset from the upper guide portion on the associated rail to engage the respective forward and rear guide rails on the outer rod at a level below the hems on the upper edges thereof. A plurality of drapery carriers are mounted in the rod each having a head portion adapted to engage the hemmed upper edges of the rails on the upper rod and the upper guide portions of the rails on the inner rod, and shank portions that extend downwardly from the head portions through the slots in the inner and outer rods.

In accordance with another aspect of the present invention, the traverse rod assembly comprises inner and outer telescopically adjustable rods each having a downwardly opening slot at the bottom and forward and rear guide rails along opposite sides of the slot, and the inner and outer rods are provided with reentrant angles at the top and bottom at a location rearwardly of the slot in the rod, and a mounting bracket is formed to engage the top and bottom reentrant angles to provide a concealed support for the rod at the rear side thereof. The reentrant angle on the bottom wall means of the inner rod is advantageously formed so that its crest is disposed alongside and at the same level as the upper edge of the rear rail on the outer rod and the rear rail of the inner rod extends downwardly from the crest and terminates in a hemmed lower edge with the hem disposed at the side of the rear rail adjacent the slot in the inner rod.

DETAILED DESCRIPTION

Figure 1:
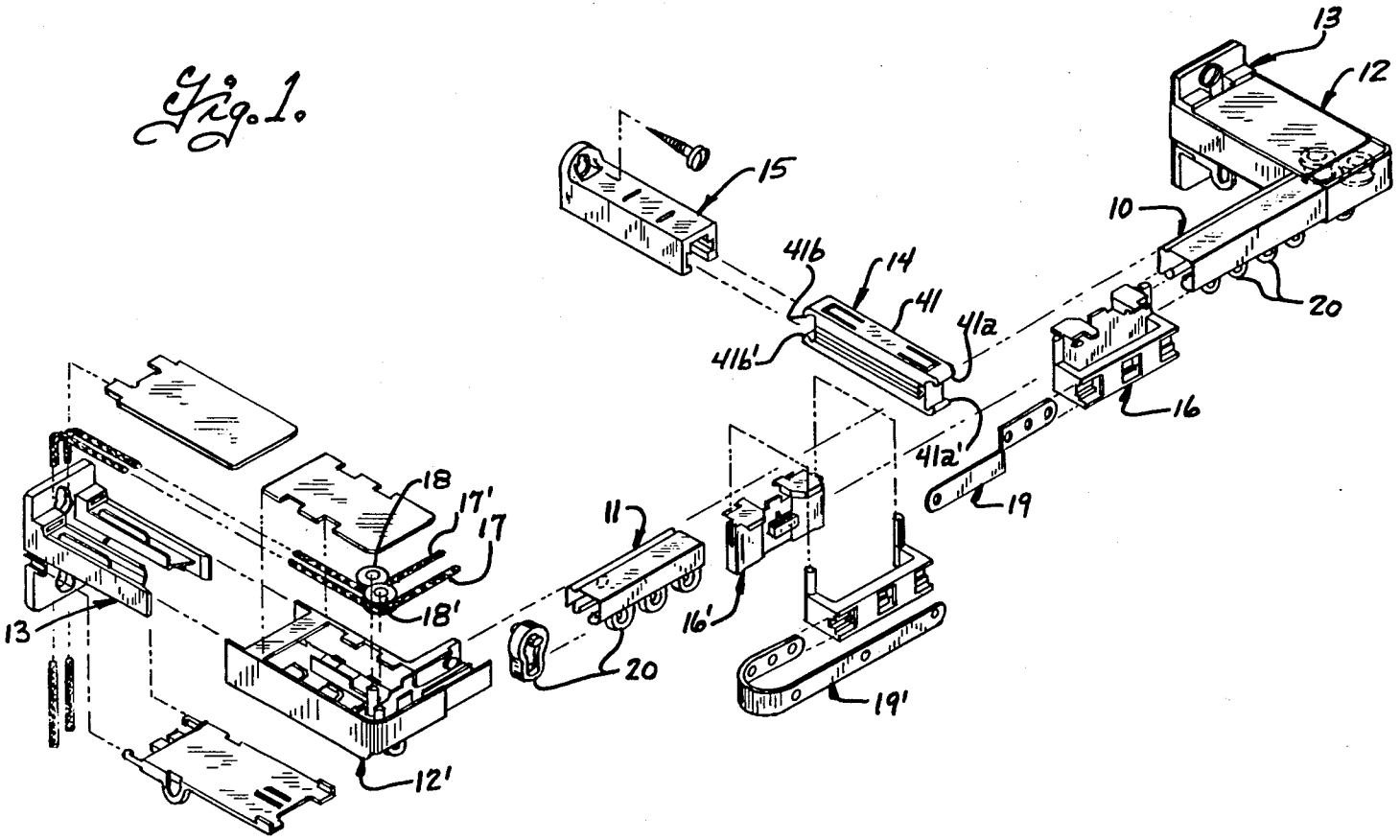
FIG. 1 is an exploded perspective view of an adjustable traverse rod embodying the present invention.

Reference is now made more specifically to FIG. 1 of the drawings wherein there is illustrated a traverse rod assembly embodying the present invention. In general, the adjustable traverse rod assembly is of the type having a downwardly opening slot in the bottom thereof and includes an outer rod 10 and an inner rod 11 telescopically receivable in the outer rod. Pulley housings 12 and 12' are provided at opposite ends of the traverse rod assembly and the pulley housings are supported on mounting brackets 13 adapted for attachment to the supporting surface such as a wall, window or the like. One or more intermediate rod engaging brackets 14 are provided for engaging the rod assembly intermediate its ends and the intermediate rod engaging bracket is mounted on an intermediate support bracket 15 for attachment to a supporting surface. One or more master carriers, herein shown two in number and designated 16, 16' are mounted for movement along the rod assembly and the master carriers are operated by traverse cords having runs 17, 17' extending lengthwise of the rod assembly and entrained over pulleys 18, 18' in the pulley housings 12 and 12' respectively. The traverse cords are operatively connected to the master carriers to effect movement of the master carriers along the rod assembly and the master carriers 16 and 16' have drapery support arms 19, 19' for supporting the lead edge of the drapery panels. A plurality of auxiliary drapery carriers 20 are also slidably supported in the rod assembly to support the drapery panel at locations intermediate the master carrier and the pulley housings at the ends of the rod assembly.

Figure 3:
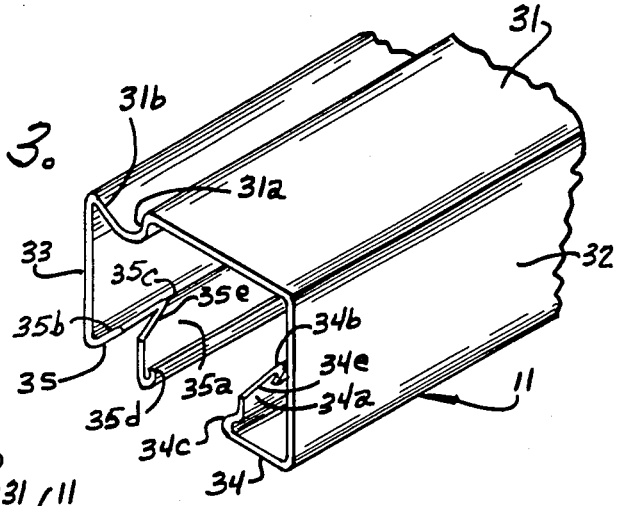
FIG. 3 is a fragmentary perspective view of one end of the inner rod.
Figure 4:
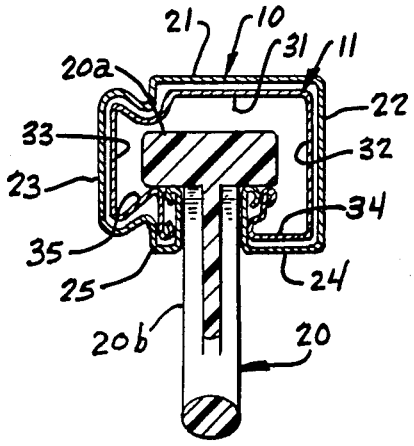
FIG. 4 is a transverse sectional view through the telescoped inner and outer rod and illustrating a drapery carrier mounted therein.
Figure 5:
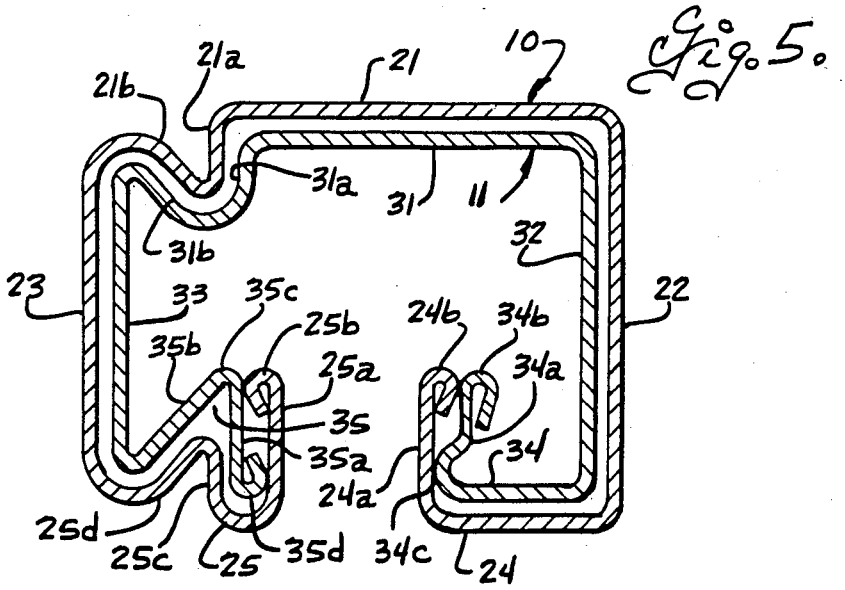
FIG. 5 is a transverse sectional view through overlapping portions of the adjustable traverse rod assembly illustrating the rods on an enlarged scale.

The outer and inner hollow rods 10 and 11 are formed of strip metal and are illustrated in FIGS. 2–5 on enlarged scale to better illustrate the construction and clearances between the inner and outer rods. For example, the adjustable rod assembly is preferably formed with a small cross-sectional profile, for example about 0.75 inches from front to rear of the outer rod and 0.575 inches from top to bottom of the outer rod, and the illustrations in FIG. 5 is on a scale about 4.75 times full size. The inner and outer rods may, for example, be formed of sheet stock having a thickness of the order of 0.020 inches and the inner rod dimensioned sufficiently smaller than the outer rod to provide a small clearance between corresponding walls of the inner and outer rods of the order of the thickness of the sheet metal stock, for example a nominal clearance of the order 0.020 inches.

The outer rod 10 includes top wall means 21, front wall means 22, rear wall means 23, and forward and rear bottom wall means 24 and 25 that are spaced apart to define a downwardly opening slot at the bottom of the outer rod. The inner rod 11 includes a top wall means 31, front wall means 32, rear wall means 33, and forward and rear bottom wall means 34 and 35 that are spaced apart to define a downwardly opening slot at the bottom of the inner rod. As shown in FIGS. 4 and 5, the top wall means 31, front wall means 32, rear wall means 33, and forward and rear bottom wall means 34 and 35 of the inner rod extend alongside corresponding wall means of the outer rod, when the inner rod is telescoped into the outer rod.

The forward bottom wall means 24 extends rearwardly from the lower edge of the front wall 22 and has a forward guide rail **24*a* extending upwardly along one side of the slot in the outer wall and terminating in a hemmed upper edge 24*b* that is rolled or folded in a direction away from the slot so that the hem lies at the side of the rail 24*a* remote from the slot in the outer rod. The rear bottom wall means 25 of the outer rod has a rail 25*a* extending upwardly along the other side of the slot in the outer rod and which terminates in a hemmed upper edge 25*b* that is rolled or folded outwardly in a direction away from the slot in the outer rod so that the hem is disposed at the side of the rail 25*a* remote from the slot in the outer rod. The hemmed upper edges 24*b* and 25*b* of the rails 24*a* and 25*a* respectively are disposed at substantially the same level to guidably support the heads 20*a* on the carriers 20 for movement along the outer rod. The rear wall means 25 of the outer rod also has a lengthwise extending reentrant angle formed by wall portions 25*c* and 25*d* and which define a downwardly opening channel adjacent the rear wall means 23 and rearwardly of the rear guide rail 25*a*. The top wall means 21 has a reentrant angle formed by wall portions 21*a* and 21*b* and which define an upwardly opening channel adjacent the rear wall means 23**. As described more fully hereinafter, the reentrant angles formed in the rear bottom wall means and in the top wall means form a dovetail like configuration at the rear of the outer rod and which is adapted to be engaged by a rear mounting bracket.

The forward bottom wall means 34 of the inner rod 11 has a forward rail means extending upwardly along one side of the slot in the inner rod. The forward rail means on the inner rod includes a forward guide rail **34*a* that extends upwardly along one side of the slot in the inner rod and which terminates in a hemmed upper edge 34*b* with the hem rolled or folded outwardly away from the slot so that the hem is disposed at the side of the rail 34*a* remote from the slot in the inner rod. The rolled upper edge 34*b* on the forward rail of the inner rod is disposed at substantially the same level as the hemmed upper edge 24*b* on the forward rail 24*a* of the outer rod to underlie and support the head 20*a* of the drapery carriers as they move along the inner rod. The forward rail 34*a* also has a lower portion 34*c* of generally U-shaped cross-section that is horizontally and vertically offset from the hemmed upper edge 34*b* in a direction such that the crest of the U-shaped lower portion engages the forward rail 24*a* of the outer rod at a level below the hem 24*b* on the upper edge of that rail, when the inner rod is telescoped into the outer rod. The crest of the U-shaped lower portion 34*c* on the rail 34*a* of the inner rod is arranged to engage and laterally guide the shank portion 20*b* of the carriers 20** during movement along the inner rod.

The rear bottom wall means 35 of the inner rod has a reentrant angle defined by wall portions 35*a* and 35*b* and which form a downwardly opening channel adjacent the rear wall 33 of the inner rod. The wall portions 35*a* and 35*b* intersect at a crest 35*c* that is disposed at substantially the same level as the hemmed upper edge 25*b* of the rail 25*a* on the outer rod, and the wall portion 35*b* extends downwardly from the crest and defines a rear guide rail along the rear side of the slot in the inner rod. The rail 35*b* has a hemmed lower edge 35*d* with the hem rolled or folded forwardly so that the hem lies at the side of the rail 35*b* adjacent the slot in the inner rod. The hemmed lower edge 35*d* on the rail 35*b* of the inner rod is arranged to engage the rear rail 25*a* on the outer rod at a location below the hemmed upper edge 25*b* thereon, when the inner rod is telescoped into the outer rod, and the hemmed lower edge 35*d* laterally guides the carriers 20 during movement along the inner rod. The hemmed lower edge 35*d* is preferably disposed at a level adjacent the level of the forward bottom wall means 34 of the inner rod.

Figure 2:
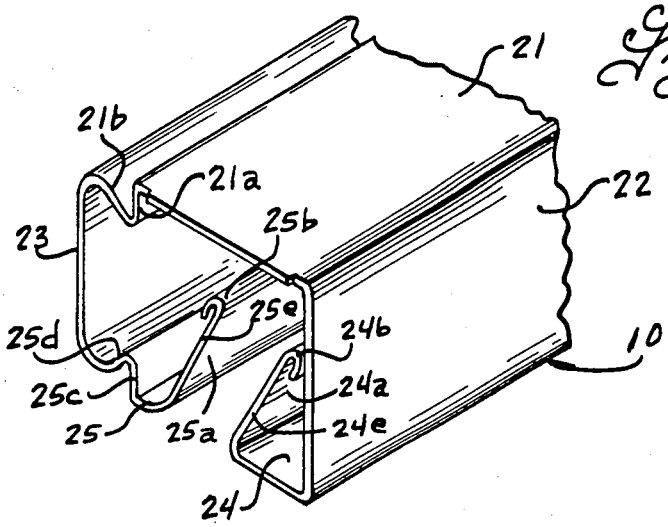
FIG. 2 is a fragmentary perspective view of one end of the outer rod.

The top wall means 31 of the inner rod is formed with a reentrant angle defined by wall portions 31*a* and 31*b* and which form an upwardly opening channel adjacent the rear wall 33 of the inner rod. The upwardly and downwardly opening channels adjacent the rear wall of the inner rod form a dovetail like configuration which is adapted to be engaged by a rod mounting bracket. As will be seen from FIG. 4, the heads 20*a* of the carriers 20 are guidably supported by the hemmed upper edges 24*b* and 25*b* on the rails 24*a* and 25*a*, respectively during movement along the outer rod and the heads of the carriers are guidably supported on the rolled upper edge on the forward guide rail 34*a* and by the rolled crest portion 35*c* on the rear guide rail 35*b* during movement along the inner rod. Thus, the heads on the carriers are supported on rolled or hemmed edges during movement along the entire length of the rod assembly. The hemmed upper edges 24*b* and 25*b* on the rails of the outer rod are disposed at the same level and the hemmed upper edge 34*b* and the crest 35*c* on the rails of the inner rod are disposed at substantially the same level as the hemmed upper edges 24*b* and 25*b* when the rods are telescoped together, with variation in height limited by the clearance between the inner and outer rods. As previously indicated, this clearance is very small, for example of the order of 0.020 inches. The shanks 20*b* of the carriers 20 are laterally guided during movement along the outer rod by the rails 24*a* and 25*a* and they are laterally guided during movement along the inner rod by the lower rail portion 34*c* and the lower hemmed edge 35*d* on the rails 34*a* and 35*a* respectively. The inner rod 11 is preformed so that the lower guide portion 34*c* on the forward rail of the inner rod and the hemmed lower edge 35*d* on the rear rail of the inner rod are spaced slightly less than the spacing between the outer faces of the rail portions 24*a* and 25*a* on the outer rod section so that the lower portions of the inner rod section have to spread slightly when the inner rod is telescoped into the outer rod to assure that the lateral guide portions of the inner rod engage the guide rails of the outer rod. Accordingly, when the inner rod is telescoped into the outer rod, the spacing between the rear hemmed edge 35*d* and the lower rail portion 34*c* on the inner rod exceeds the spacing between the rails 24*a* and 25*a* on the outer rod by no more than two times the thickness of the metal strip from which the rods are formed. Thus, the slides do not have to move sideways by more than a single metal thickness at the transition between the telescoped ends of the inner and outer rods. In order to further smooth the transition between the telescoped ends of the inner and outer rods and accommodate manufacturing tolerances, the ends of the rails 24*a*, 25*a* of the outer rod are beveled as shown at 24*e* and 25*e* in FIG. 2. The bevels 24*e* and 25*e* preferably extend from the respective bottom wall upwardly at an acute angle to the upper edge of the respective rail. The end of the rails 34*a* and 35*b* on the inner rods also have a beveled portion as shown in FIG. 3. This beveling can be easily achieved by forming V-notches in the strip at appropriate locations prior to roll forming the strip into the inner and outer rods. While it is only necessary to bevel the ends of the rails at the telescoped ends of the rod, opposite ends of each rod are conveniently similarly beveled. For convenience in illustrating, FIGS. 2 and 3 show the bevels on the left ends of the respective rod sections as viewed from the front, it being understood that the other ends of each rod are similarly beveled.

As previously described, the upwardly and downwardly opening channels in the top and bottom walls of the inner and outer rods form a dovetail like portion at the rear of each of the rods which is adapted for engagement by a rear mounting bracket. The mounting bracket may, for example, be of the type shown at 14, 15 in FIG. 1 and more fully disclosed and claimed in my co-pending application Ser. No. 943,377, filed Dec. 16, 1986. In general, the rod mounting bracket 14 comprises a rod engaging member 41 having upper and lower jaws 41*a*, 41*a'* at one end adapted for engagement with the upper and lower channels in the outer rod section and jaws 41*b*, 41*b'* at the other end adapted for engagement with the upper and lower channels in the inner rod section. The rod engaging member is adjustably mounted on the wall mounting bracket 15 to support either the outer or inner rod at a location intermediate its ends.

The runs 17, 17' of the traverse cord extend between the pulleys 18, 18' on the pulley housing along paths that are respectively forwardly and rearwardly of the slots in the inner and outer rods. The forward bottom wall 24 having an upwardly extending rail 24*a* forms a forward channel inside the rod and the rear bottom wall 25 and rail 25*a* forms a rear channel inside the outer rod for receiving the runs of the traverse cord and for retaining the same against drooping out of the slot in the outer rod. The forward bottom wall means 34 and rail 34*a* on the inner rod forms an upwardly extending channel at the front side of the inner rod and the upwardly inclined wall 35*a* forms an upwardly opening channel with the rear wall 33 inside the inner rod for receiving and retaining the rear run of the traverse cord.

From the foregoing it is thought that the construction and operation of the traverse rod assembly will be readily understood. During movement of the master and auxiliary carriers 16, 16' and 20 along the rod, the heads on the carriers are supported on the hemmed upper edges 24*b*, 25*b* of the rails 24*a* and 25*a* during movement along the outer rod and the heads are supported on the hemmed upper edge 34*b* and the rolled surface 35*c* at the upper edge of the rails 34*a* and 35*b* of the inner rod section during movement along the latter. The shanks of the carriers are laterally guided between the rails 24*a* and 25*a* during movement along the outer rod section and are laterally guided by the lower rail portion 34*c* and the hemmed lower edge 35*d* on the rail 35*b* during movement along the inner rod. The carriers are supported at substantially the same level during movement along the inner and outer rods and the carriers do not have to move sideways a distance more than a single thickness of the metal used in forming the rods, during the transition from one rod to the other. Thus, the telescoping inner and outer rods overcome the problems of wear and drag that occur with prior telescoping rods in which the carriers are supported on the slit edges of the rods, while yet providing a smooth transition for the carriers as they move from one rod to the other. The reentrant angles in the top and bottom of the rod provide dovetail like portions on the inner and outer rods at a location rearwardly of the downwardly opening slot in the rods and which can be gripped by a rod support bracket so that the rod support bracket is concealed from view from the front of the rod. The inner and outer rods are also shaped to provide trap areas for the traverse cord at locations forwardly and rearwardly of the slot in the rods to prevent the cords from dropping out of the rod or becoming entangled with the carriers during movement along the rod.

Figure 6:
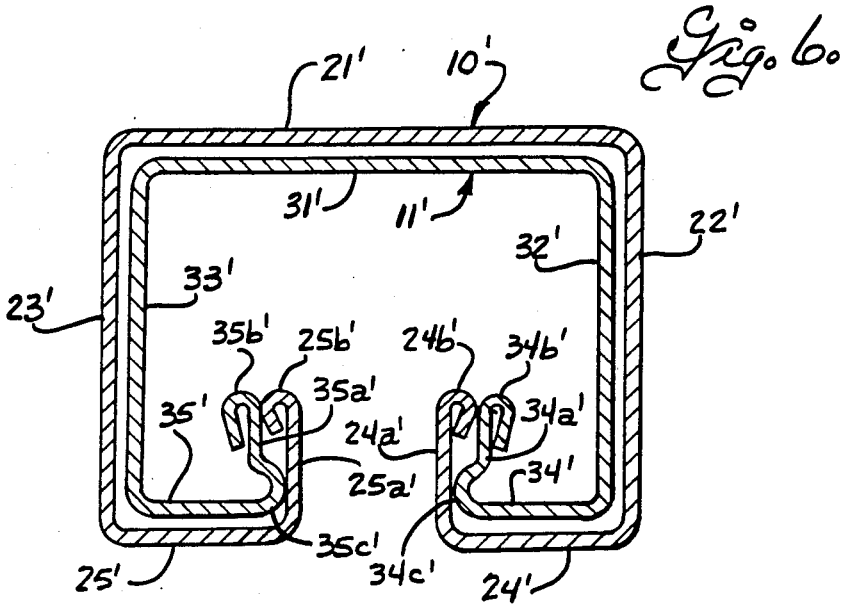
FIG. 6 is a transverse sectional view through a modified form of adjustable traverse rod.

A modified form of rod section is illustrated in FIG. 6, and like numerals followed by the postscript ′ are used to designate corresponding parts. In this embodiment the outer rod 10′ has a top wall 21′, front wall 22′, rear wall 23′ and forward and rear bottom walls 24′ and 25′ that are spaced apart and define a slot therebetween. Forward and rear carrier guide rails **24*a*′ and 25*a*′ extend upwardly from the respective forward and rear bottom walls and terminate in hemmed upper edges 24*b*′ and 25*b*′ respectively, with the hems located at the sides of the associated rail remote from the slot in the outer rod. The inner rod 11′ has a top wall 31′, front wall 32′, rear wall 33′ and forward and rear bottom walls 34′ and 35′ that are spaced apart and define a slot therebetween. Forward and rear carrier guide rails 34*a*′ and 35*a*′ extend upwardly from the respective forward and rear bottom walls and terminate in hemmed upper edges 34*b*′ and 35*b*′ respectively with the hems located at the sides of the associated rail remote from the slot in the inner rod. The hemmed upper edges 24*b*′ and 25*b*′ on the outer rod are disposed at the same level to underlie and support the head portion 20*a* on the carriers 20, and the hemmed upper edges 34*b*′ and 35*b*′ on the inner rod are disposed alongside and at substantially the same level as the upper edges 24*b*′ and 25*b*′ on the outer rod. The rails 34*a*′ and 35*a*′ on the inner rod have lower guide portions 34*c*′ and 35*c*′ respectively that are horizontally and vertically offset the hemmed upper edge on the associated rail to engage the respective forward and rear guide rails on the outer rod at the sides thereof remote from the slot in the outer rod and at a level below the hems on the upper edges thereof. As described in connection with the previous embodiment, the guide rails 24*a*′ and 25*a*′ are laterally spaced apart a distance slightly greater than thickness of the shank portion of the carriers to laterally guide the carriers during movement along the outer rod. The lower guide portions 34*c*′ and 35*c*′** on the inner rod are arranged to engage the outer sides of the rails on the outer rod and laterally guide the shank portions of the carriers during movement along the inner rod. The ends of the rails on the inner and outer rods are preferably beveled in the manner described in connection with the previous embodiment.

The carriers are supported at substantially the same level on hemmed upper edges during movement along the inner and outer rods and the carriers do not have to move sideways a distance more than a single thickness of the metal used in forming the rods during movement from one rod to the other. Thus, the telescoping inner and outer rods overcome the problems of wear and drag that occur with prior telescoping rods in which the carriers are supported on the slit edge of the rods, while yet providing a smooth transition for the carriers as they move from one rod to the other.

The embodiments of the invention in which an exclusive property or privilege is claimed are defined as follows:

1. A traverse rod assembly comprising, inner and outer hollow rods formed of strip metal and each including top wall means, front wall means, rear wall means, and forward and rear bottom wall means spaced apart to define a downwardly opening slot therebetween, the inner rod having an external cross-section sufficiently smaller than the outer rod such that one end thereof is telescopically receivable in one end of the outer rod, the forward and rear bottom wall means of the outer rod having respective forward and rear carrier guide rails extending upwardly along opposite sides of the slot in the outer rod, the forward and rear bottom wall means of the inner rod having respective forward and rear carrier guide rails along opposite sides of the slot in the inner rod, the forward and rear carrier guide rails on the outer rod each having a hemmed upper edge with the hem disposed at the side of the associated rails remote from the slot in the outer rod, the forward and rear guide rails on the inner rod each having an upper guide portion disposed alongside and at substantially the same level as the hemmed upper edges of the respective forward and rear guide rails on the outer rod, the forward and rear guide rails on the inner rod each having a lower guide portion horizontally and vertically offset from the upper guide portion on the associated rail and arranged to engage the respective forward and rear guide rails on the outer rod at the sides thereof remote from the slot in the outer rod and at a level below the hems on the upper edges thereof, and a plurality of drapery carriers each having a head portion adapted to engage the hemmed upper edges of the guide rails on the outer rod and the upper guide portions of the guide rails on the inner rod and a shank portion adapted to extend downwardly from the head portion through the slots in the inner and outer rods and engage the lower guide portions.

2. A traverse rod assembly according to claim 1 wherein the upper guide portion on the forward guide rail on the inner rod comprises a hemmed upper edge with the hem disposed at the side of the forward guide rail on the inner rod remote from the slot in the inner rod.

3. A traverse rod assembly according to claim 1 wherein said rear guide rail on the inner rod has a hemmed lower edge with the hem disposed at the side of the rear guide rail on the inner rod adjacent the slot in the inner rod.

4. A traverse rod assembly according to claim 1 wherein the rear bottom wall means of the inner rod has a lengthwise extending reentrant angle with the rear carrier guide rail on the inner rod forming one side of the reentrant angle, said rear carrier guide rail on the inner rod having a hemmed lower edge with the hem disposed at the side of the rear guide rail on the inner rod adjacent the slot in the inner rod.

5. A traverse rod according to claim 2 wherein the rear bottom wall means of the inner rod has a lengthwise extending reentrant angle with the rear carrier guide rail on the inner rod forming one side of the reentrant angle, said rear carrier guide rail on the inner rod having a hemmed lower edge with the hem disposed at the side of the rear guide rail on the inner rod adjacent the slot in the inner rod.

6. A traverse rod assembly according to claim 1 wherein the top wall means of inner and outer rods each have a lengthwise extending reentrant angle adjacent their respective rear wall means defining an upwardly opening channel, the rear bottom wall means of the inner and outer rods each having a lengthwise extending reentrant angle adjacent their respective rear wall means defining a downwardly opening channel, and at least one rod support bracket having means for engaging the upwardly and downwardly opening channels in at least one of the rods.

7. A traverse rod assembly according to claim 6 wherein rear carrier guide rail on the inner rod forms one side of the reentrant angle on the rear bottom wall means of the inner rod.

8. A traverse rod assembly according to claim 6 wherein the rear carrier guide rail on the inner rod forms one side of the reentrant angle on the rear bottom wall means of the inner rod, the rear carrier guide rail on the inner rod having a hemmed lower edge with the hem disposed at the side of the rear guide rail on the inner rod adjacent the slot in the inner rod.

9. A traverse rod assembly according to claim 8 wherein the upper guide portion on the forward guide rail on the inner rod comprises a hemmed upper edge with the hem disposed at the side of the forward guide rail on the inner rod remote from the slot in the inner rod.

10. A traverse rod assembly according to claim 1 wherein the upper guide portion on each of the forward and rear guide rails on the inner rod comprise a hemmed upper edge with the hem disposed at the side of the associated rail remote from the slot in the inner rod, the lower guide portions on each the forward and rear guide rails on the inner rod having a generally U-shaped cross-section with the apex of the U-shaped lower guide portions on the forward and rear rails of the inner rod respectively engaging the forward and rear guide rails on the outer rod.

11. A traverse rod assembly according to claim 1 wherein the ends of forward and rear guide rails on the outer rod at said one end of the latter are inclined upwardly in a direction lengthwise of the outer rod from adjacent the respective forward and rear bottom wall means to their hemmed upper edges.

12. A traverse rod assembly according to claim 1 wherein the ends of the forward and rear guide rails on the inner rod at said one end of the latter have portions inclined upwardly in a direction lengthwise of the inner rod.

13. A traverse rod assembly comprising telescopically adjustable inner and outer hollow rods formed of strip metal and each including top wall means, front wall means, rear wall means, and forward and rear bottom wall means spaced apart to define a downwardly opening slot therebetween, the inner rod having an external cross-section sufficiently smaller than the outer rod such that one end thereof is telescopically receivable in the outer rod, the top wall means of the inner and outer hollow rods each having a lengthwise extending reentrant angle adjacent their respective rear wall means defining an upwardly opening channel, the rear bottom wall means of the inner and outer hollow rods each having a lengthwise extending reentrant angle adjacent their respective rear wall means defining a downwardly opening channel, at least one rod support bracket having means for engaging the upwardly and downwardly opening channels in at least one of the rods, a plurality of drapery carrier means movable along the rod assembly, said forward and rear bottom wall means of the outer rod respectively including forward and rear carrier guide rails extending upwardly along opposite sides of the slot in the outer rod and terminating in respective forward and rear upper edge means, the forward bottom wall means of the inner rod including a forward carrier guide rail extending upwardly along one side of the slot in the inner rod and terminating in an upper edge means disposed at substantially the same level as the forward upper edge means of the outer rod, the reentrant angle of the rear bottom wall means of the inner rod having a crest forming an upper edge means and disposed at substantially the same level as the rear upper edge means of the outer rod, and a rear rail extending downwardly from the crest along the other side of the slot in the inner rod and terminating in a lower edge means, the drapery carrier means being movable along the upper edge means, the drapery carrier means including a shank which engages the lower edge means.

14. A traverse rod assembly according to claim 13 wherein each of the edge means on the inner and outer rods are hemmed edges.

15. A traverse rod assembly according to claim 13 wherein the forward and rear upper edge means on the outer rod are each hemmed edges with the hems disposed at the sides of the associated rail remote from the slot in the outer rod, the forward upper edge means on the inner rod being a hemmed edge with the hem disposed at the side of the associated rail remote from the slot in the inner rod, and the lower rear edge means on the inner rod being a hemmed edge with the hem disposed at the side of the associated rail adjacent the slot in the inner rod.

16. A traverse rod assembly according to claim 15 wherein the forward rail on the inner rod includes a lower rail portion adapted to engage the forward rail on the outer rod at a location below the forward upper edge means thereon, the forward rail on the inner rod also including an upper rail portion offset from the lower rail portion to extend alongside the forward upper edge means on the outer rod.

17. A traverse rod assembly comprising, inner and outer hollow rods formed of strip metal and each including top wall means, front wall means, rear wall means, and forward and rear bottom wall means spaced apart to define a downwardly opening slot therebetween, the inner rod having an external cross-section sufficiently smaller than the outer rod to have one end telescopically receivable in one end of the outer rod, the forward and rear bottom wall means of the outer rod having respective forward and rear carrier guide rails extending upwardly along opposite sides of the slot in the outer rod and each having a hemmed upper edge with the hem disposed at the side of the associated rail remote from the slot in the outer rod, the forward and rear bottom wall means on the inner rod having respective forward and rear guide rails extending upwardly along opposite sides of the slot in the inner rod and each having a hemmed upper edge with the hem disposed at the side of the associated rail remote from the slot in the inner rod, the forward and rear guide rails on the inner rod having their hemmed upper edges disposed alongside and at substantially the same level as the hemmed upper edges on the respective forward and rear guide rails on the outer rod, the forward and rear guide rails on the inner rod each having a lower guide portion horizontally and vertically offset from the hemmed upper edge on the associated rail and arranged to engage the respective forward and rear guide rails on the outer rod at the sides thereof remote from the slot in the outer rod and at a level below the hems on the upper edges thereof, and a plurality of drapery carriers each having a head portion adapted to engage the hemmed upper edges on the guide rails of the inner and outer rod and a shank portion adapted to extend downwardly from the head portion through the slots in the inner and outer rods and engage the lower guide portions.

18. A traverse rod assembly according to claim 17 wherein the ends of forward and rear guide rails on the outer rod at said one end of the latter are inclined upwardly in a direction lengthwise of the outer rod from adjacent the respective forward and rear bottom wall means to their hemmed upper edges.

19. A traverse rod assembly according to claim 18 wherein the ends of the forward and rear guide rails on the inner rod at said one end of the latter have portions inclined upwardly in a direction lengthwise of the inner rod.

* * * * *